United States Patent [19]

Ooyama et al.

[11] Patent Number: 4,671,219

[45] Date of Patent: Jun. 9, 1987

[54] TWO-STROKE INTERNAL COMBUSTION ENGINE

[75] Inventors: Kazuo Ooyama, Saitama; Yasuhiko Nakano, Tokyo, both of Japan

[73] Assignee: Honda Giken Kogyo Kabushiki Kaisha, Tokyo, Japan

[21] Appl. No.: 531,224

[22] Filed: Sep. 9, 1983

[30] Foreign Application Priority Data

Sep. 11, 1982 [JP] Japan ..... 57-137894[U]
Sep. 25, 1982 [JP] Japan ..... 57-145132[U]

[51] Int. Cl.[4] ..... F02B 33/04

[52] U.S. Cl. ..... 123/65 A; 123/65 P; 123/73 PP; 92/177

[58] Field of Search ..... 123/65 R, 65 VC, 65 A, 123/65 W, 65 P, 73 PP, 65 PD; 92/177

[56] References Cited

U.S. PATENT DOCUMENTS

| | | | |
|---|---|---|---|
| 1,632,988 | 6/1927 | Adams | 123/65 A |
| 2,190,011 | 2/1940 | Boxan | 123/65 A |
| 2,760,469 | 8/1956 | Kremser | 123/65 P |
| 4,174,685 | 11/1979 | Meier | 123/65 A |
| 4,287,860 | 9/1981 | Fujikawa et al. | 123/73 R |
| 4,306,730 | 12/1981 | Honda et al. | 92/177 |
| 4,329,948 | 5/1982 | Fujikawa et al. | 123/65 P |
| 4,373,474 | 2/1983 | Schindler et al. | 123/65 PD |

FOREIGN PATENT DOCUMENTS

| | | | |
|---|---|---|---|
| 9616 | 1/1981 | Japan | 123/65 P |
| 32036 | 4/1981 | Japan | 123/193 P |
| 73826 | 5/1982 | Japan | 123/193 P |
| 478959 | 1/1938 | United Kingdom | 123/65 A |
| 2027795 | 2/1980 | United Kingdom | 92/177 |

*Primary Examiner*—Craig R. Feinberg
*Assistant Examiner*—David A. Okonsky
*Attorney, Agent, or Firm*—Lyon & Lyon

[57] ABSTRACT

A two-cycle internal combustion engine having an oblong cylinder and an oblong piston therein. The engine includes two sets of scavenging ports at either end of the oblong cylinder having at least three ports each. Scavenging passages extending to the scavenging ports may be directed at sequentially increasing angles of inclination to the local normal with the cylinder away from the exhaust porting. In this way, flow may be directed across the piston head away from the exhaust porting and then upwardly to return toward the exhaust porting. A domed piston is also disclosed having discrete guide surfaces on the domed surface of the piston to specifically direct incoming air/fuel mixture upwardly from each of the scavenging ports. An element of the cylinder midway in the long dimension of the cylinder extends in the direction of piston movement without porting so as to provide a smooth wall surface. An oblong piston ring mounted within a groove in the piston has a break in the ring coincide with the unported cylinder element to reduce stress and friction.

8 Claims, 19 Drawing Figures

FIG. 10.
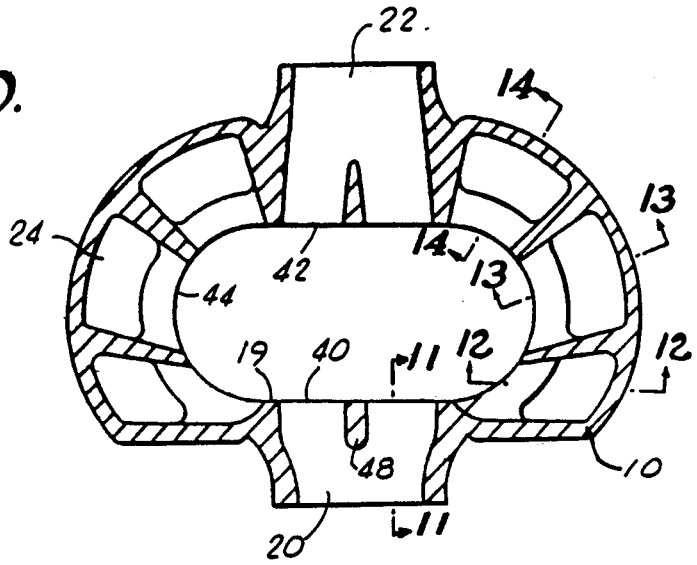
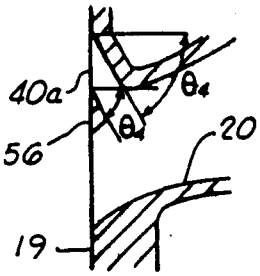
FIG. 11.
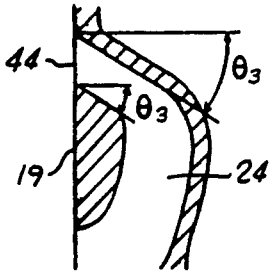
FIG. 12.
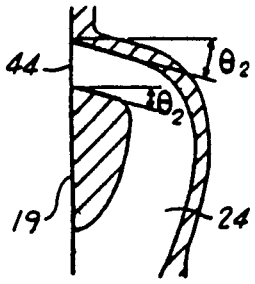
FIG. 13.
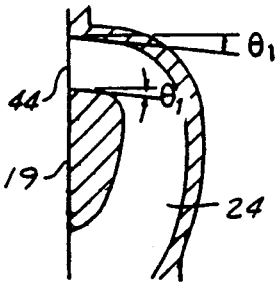
FIG. 14.
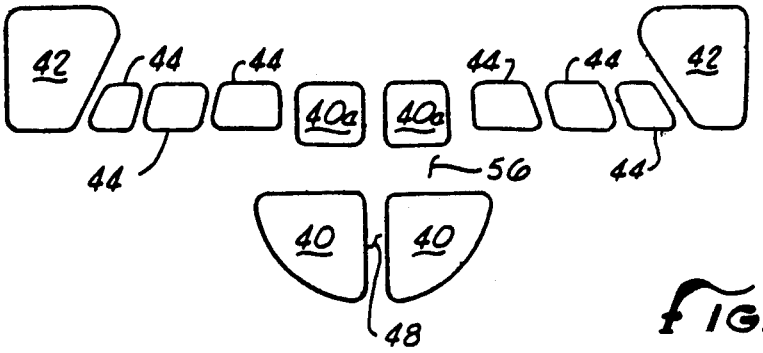
FIG. 15.

TWO-STROKE INTERNAL COMBUSTION ENGINE

BACKGROUND OF THE INVENTION

The field of the present invention is two-stroke internal combustion engines of the type employing cylinders oblong in cross-section.

Two-cycle internal combustion engines employing non-circular cylinders and pistons have been devised in an effort to increase the wall of the cylinder available for porting relative to the overall displacement. By employing a non circular cylinder for the combustion chamber arrangement, the ratio of cylinder surface area to volume increases over that of a circular configuration. As a result, a proportionally greater amount of area made available for the ports of the two-cycle engine can be realized. The term oblong has been employed in the present disclosure as a generic reference to such non-circular cross sections such as ellipses, ovals and the like.

In employing an oblong cylinder arrangement, certain disadvantages were recognized as well as the aforementioned advantage. FIG. 3 illustrates a two-cycle oblong cylinder configuration known prior to the present development. In this prior arrangement, the intake in exhaust porting was located along the long portions of the cylinder while the scavenging porting was located at the ends of the cylinder arrangement. This arrangement provided ample area for the intake and exhaust but caused the scavenging ports to be located close together and aimed toward one another. This effect is more pronounced than in a circular cylinder only in the sense that the volume served by the scavenging ports has been increased disproportionately to the radius of curvature at the scavenging porting. It has been determined that the effective scavenging port area is determined by the cord or straight-line distance between the sides of the port opening. This effective port area is seen to be significantly smaller than the arc area one might otherwise consider.

A further difficulty encountered in such oblong arrangements is that the distance between the scavenging porting and the exhaust porting is disproportionately small compared to the overall volume of the cylinder. As a result, short circuiting of scavenged air/fuel mixture to the exhaust porting is experienced while combusted gases in other areas of the combustion chamber are not effectively exhausted.

An additional problem encountered by the use of an oblong cylinder arrangement is the increase in flame path to remote areas of the combustion chamber. With a circular cylinder, the distance to the outer periphery of the combustion chamber is uniform. With an oblong arrangement, this distance can vary substantially.

Finally, the conventional sealing rings of an internal combustion engine experience substantial additional forces and moments due to the extended lengths of portions of the ring structure. This is particularly true in engines of two-stroke design having ports through the wall of the cylinder. Passage of the piston ring across the margins of such porting creates added resistance, interference and consequently stress to the piston ring.

In view of the foregoing disadvantages, the advantage of an increased ratio of cylinder area for porting to combustion chamber volume can be substantially lost.

SUMMARY OF THE INVENTION

The present invention pertains to a two-stroke internal combustion engine of an oblong cylinder design. In the several aspects of the present invention, the relative length or area deficiencies per unit of displacement volume are substantially mitigated. Additionally, a further aspect of the present invention reduces stress in the piston ring.

In one aspect of the present invention, the cord length across the scavenging port defining effective scavenging port area has been increased for a given combustion chamber volume by employing more than the conventional one or two scavenging ports. In spite of the fact that smaller and somewhat more flow resistive passages are defined by three or more scavenging passages and ports, the effective porting area as measured by the cord length across the ports is increased. As a result, scavenging efficiency is improved.

In another aspect of the present invention, the scavenging passages extending to the scavenging ports are arranged to overcome the proportionally shorter distance between the scavenging ports and the exhaust porting to circumvent air/fuel mixture short circuiting to the exhaust porting. To this end, the scavenging passages discharge at angles of inclination with the normal to the cylinder which increase with distance from the exhaust porting. In this way, flow is achieved to purge combusted gases throughout the combustion chamber.

To further distribute air/fuel mixture from the scavenging ports, a domed piston arrangement may be employed with specific concave guides for each scavenging port to direct the incoming air/fuel mixture upwardly into appropriate locations of the combustion chamber. This action provides fresh air/fuel mixture to the spark plug or spark plugs as well as aiding in the cooling of the upper portions of the combustion chamber. In this way, and through the judicious location of spark plugs, the flame path to all areas of the combustion chamber can be minimized and projected through properly constituted air/fuel mixture.

In a further aspect of the present invention, an element of the cylinder wall in a direction parallel to the motion of the piston within the cylinder is left without porting. This element is centrally arranged midway on one long side of the cylinder. The break in the piston ring is positioned at this location such that the ends of the piston ring at the break experience only the smooth wall of the cylinder without disruptive porting. In this way, stresses and friction at this point can be minimized.

Accordingly, a principal object of the present invention is to provide an improved two-stroke internal combustion engine particularly adapted to the advantageous employment of an oblong cylinder arrangement. Other and further objects and advantages will appear hereinafter.

BRIEF DESCRIPTION OF THE DRAWINGS

FIG. 10 is plan view in cross section of the combustion chamber of the device of FIGS. 8 and 9.

FIG. 11 is a cross-sectional elevation taken along line 11—11 of FIG. 10.

FIG. 12 is a cross-sectional elevation taken along line 12—12 of FIG. 10.

FIG. 13 is a cross-sectional elevation taken along line 13—13 of FIG. 10.

FIG. 14 is a cross-sectional elevation taken along line 14—14 of FIG. 10.

FIG. 15 is a development of the inner surface of the combustion chamber of the embodiment of FIG. 9 illustrating the port pattern.

DETAILED DESCRIPTION OF THE PREFERRED EMBODIMENTS

Figure 1:
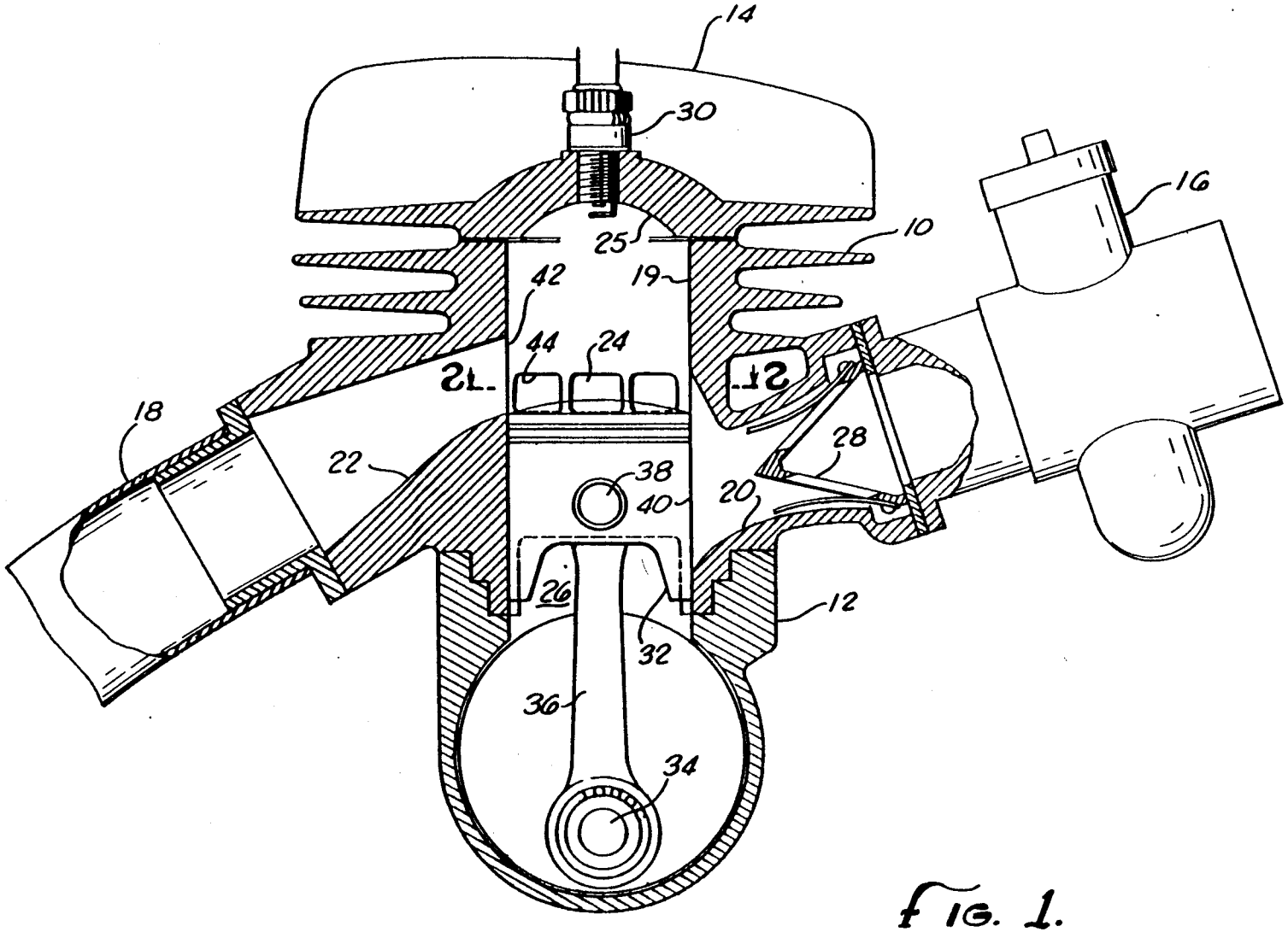
FIG. 1 is a cross-sectional elevation of a two-stroke engine of the present invention.
Figure 2:
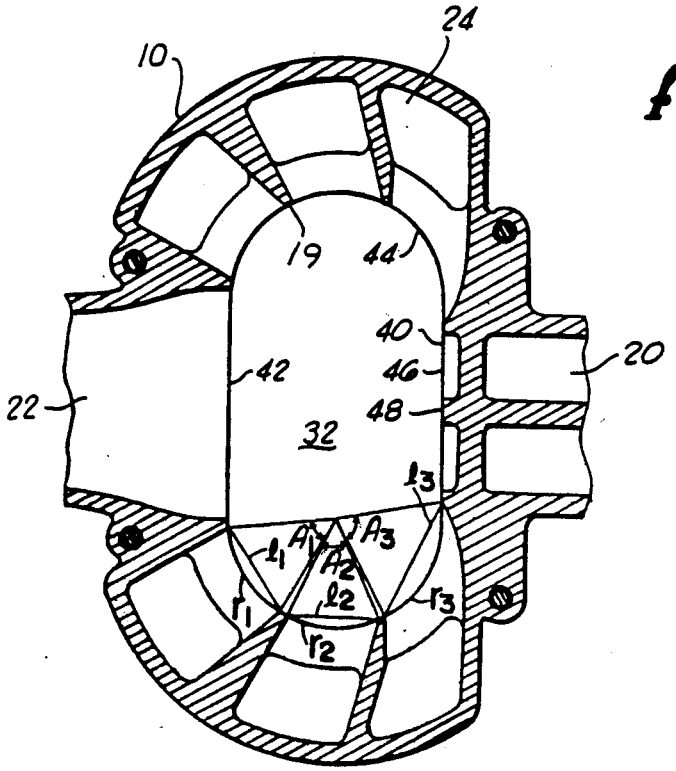
FIG. 2 is a plan view of the combustion chamber of the device of FIG. 1 taken along line 2—2 of FIG. 1.

Turning in detail to the drawings, and particularly the first embodiment of FIGS. 1 and 2, an air-cooled internal combustion engine is illustrated as including a finned cylinder block 10, a crankcase 12, a finned head 14, an intake system 16 and an exhaust system 18.

Within the cylinder block 10 are defined an oblong cylinder 19, an intake passage 20, an exhaust passage 22 and scavenging passages 24. A domed head surface 25 of the cylinder head 14 closes the top of the oblong cylinder 19. The scavenging passages 24 are connected to the crank space 26 while the intake passage 20 is in communication with the intake system 16. A reed valve assembly 28 is positioned within the intake passage 20 to provide one-way flow through that passage into the engine. The exhaust passage 22 is associated with the exhaust system 18. An ignition plug 30 is positioned at the top of the engine through the cylinder head 14.

Slidably positioned within the cylinder block 10 is a piston 32. The piston 32 is coupled to the crankshaft 34 by means of a connecting rod 36 and a wrist pin 38.

Associated with the respective passages 20, 22 and 24 in the cylinder block 10 extending to the cylinder 19 are intake porting 40, exhaust porting 42 and scavenging porting 44. As can best be seen in FIG. 2, the intake porting 40 includes intake ports 46 on either side of an element 48 of the inner wall of the cylinder block 10. Two sets of scavenging passages 24 are illustrated, the sets being opposed on either end of the oblong cylinder 19. Each set is located between the intake porting 40 and the exhaust porting 42 on opposite ends of the cylinder 19. As can be seen from the plan view of FIG. 2, the scavenging passages 24 are arranged to direct flow into the cylinder 19 in a direction away from the exhaust port 42.

The intake ports 40 extend upwardly to a level aligned with the top of the scavenging ports 44. The intake ports 40 also extend downwardly to be exposed at least during a portion of the piston stroke to the crank space 26. Additional passages may also be employed between the intake passage 20 and the crank space 26 to insure full communication therebetween. As such, the intake passage 20 associated with the extended intake port 40 may act as an auxiliary transfer passage allowing air/fuel mixture to pass upwardly from the crank space 26 to the cylinder 19. The reed valve 28 prevents flow of any pressurized fluid in the outward direction in the intake passage 20.

Figure 3:
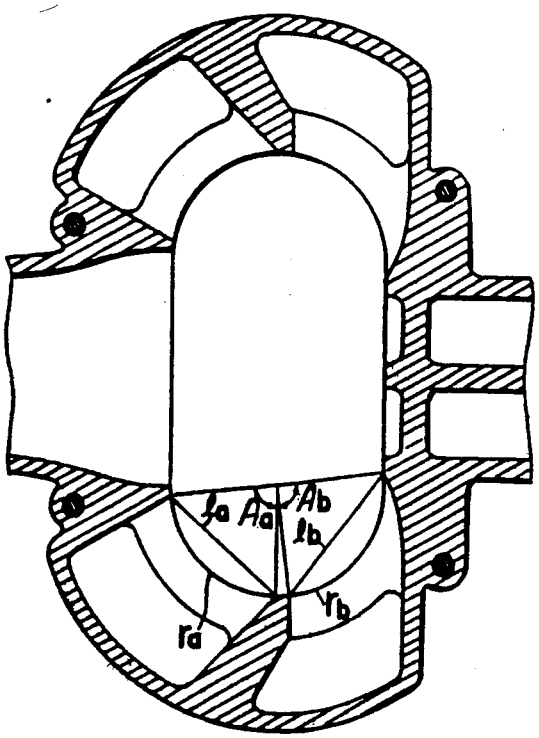
FIG. 3. PRIOR ART
FIG. 3 is a prior art plan view of a combustion chamber of a two-cycle oblong cylinder engine.

Looking then to the effective area of the scavenging porting, reference is specifically made to the lower set of scavenging ports 44 as seen in FIG. 2 to be compared with those of FIG. 3. With "r" representing cord length, "A" representing the included angles and "1" the cord length of the scavenge ports 42, then:

$$A_1, A_2, A_3, < A_a, A_b; \text{ and}$$

$$\frac{2r_{1-3}\sin A_{1-3}/2}{r\,A_{1-3}} > \frac{2r_{a-b}\sin A_{a-b}/2}{r\,A_{a-b}}$$

therefore:

$$\frac{1_{1-3}}{r_{1-3}} > \frac{1_{a-b}}{r_{a-b}}$$

Consequently, the ratios of cord lengths to arc lengths is larger for the embodiment illustrated in FIG. 2 and the corresponding effective porting area for the sets of three or more scavenging passages 24 is greater than for the more conventional sets of scavenging passages employing two passages per set.

Figure 4:
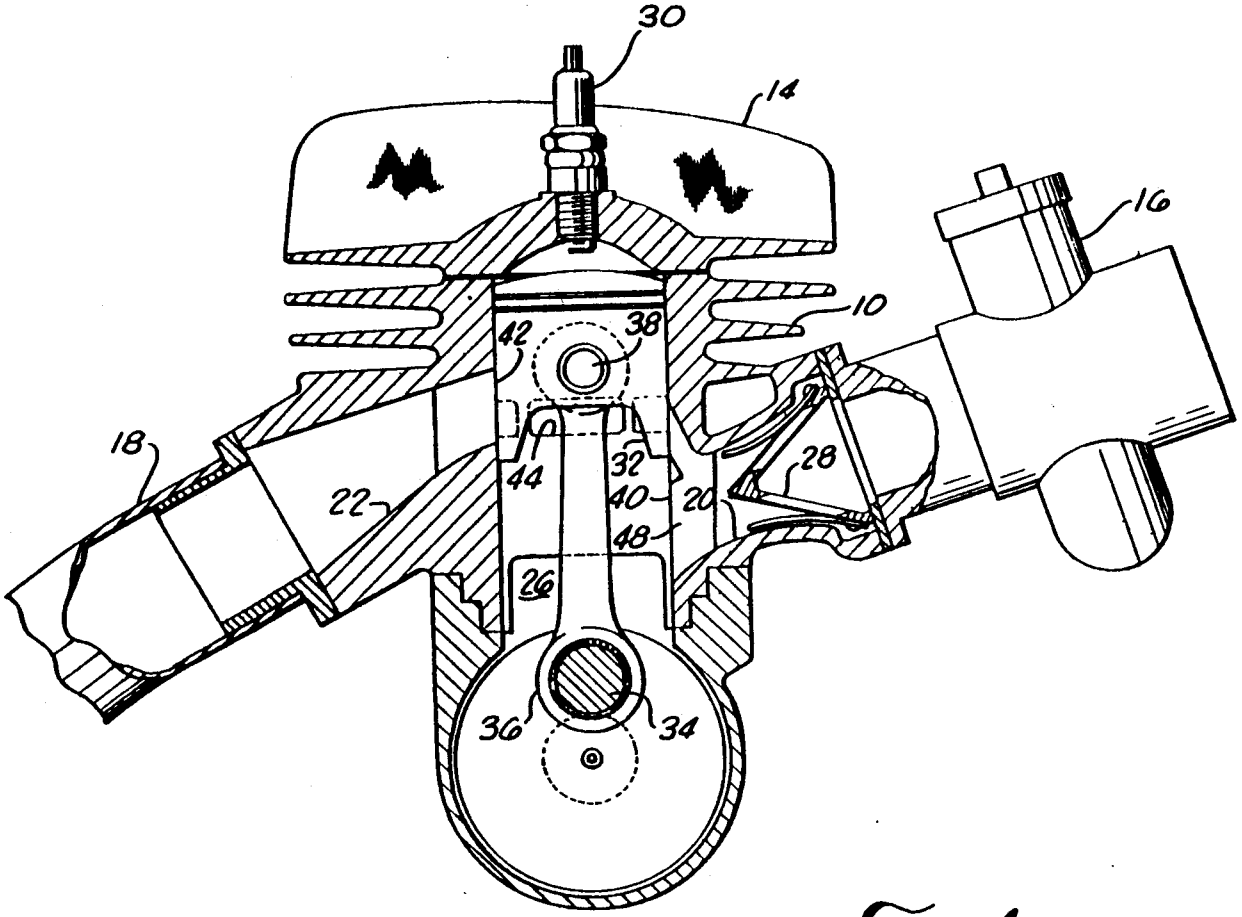
FIG. 4 is a cross-sectional elevation of a second embodiment of the present invention.
Figure 5:
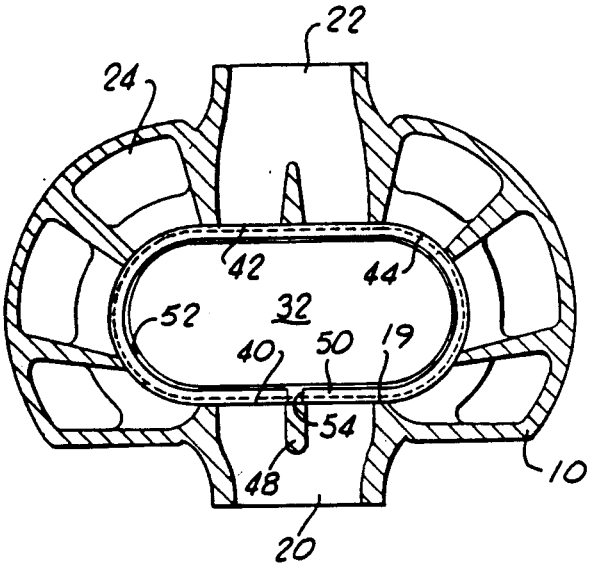
FIG. 5 is a cross-sectional plan view of the combustion chamber illustrating the porting and piston ring arrangement of the embodiment of FIG. 4.
Figure 8:
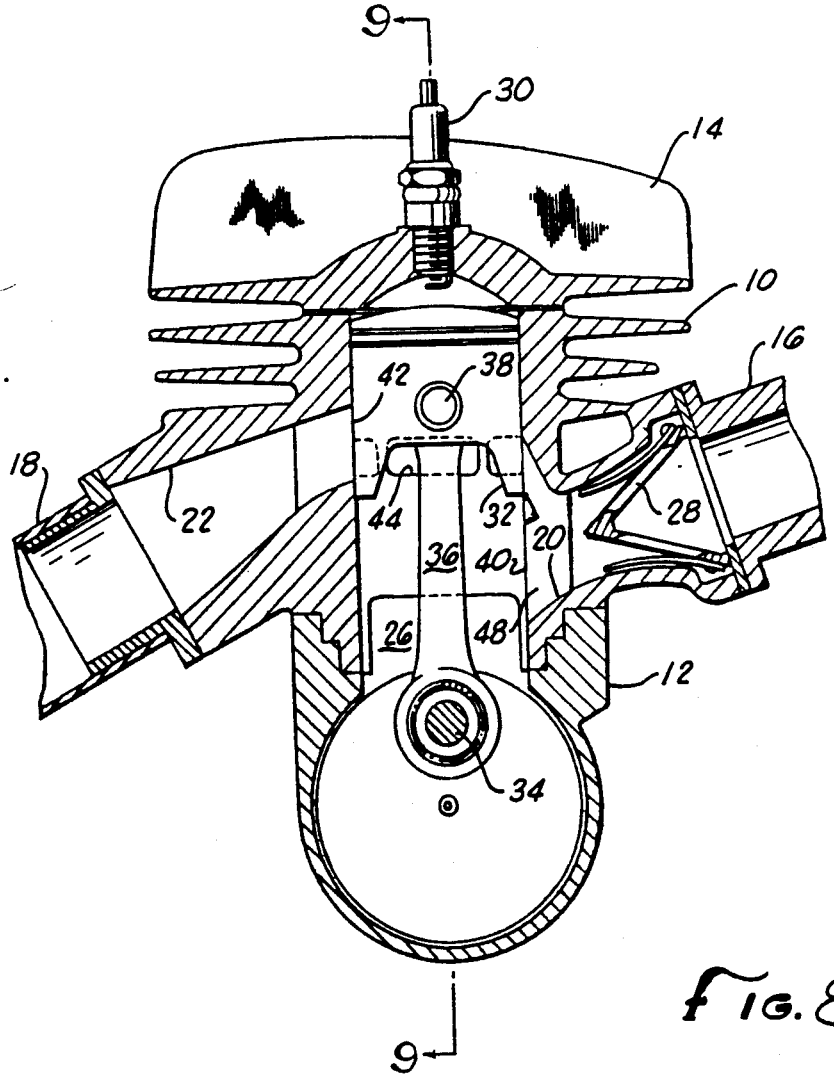
FIG. 8 is a cross-sectional elevation of yet another embodiment of the present invention.
Figure 6:
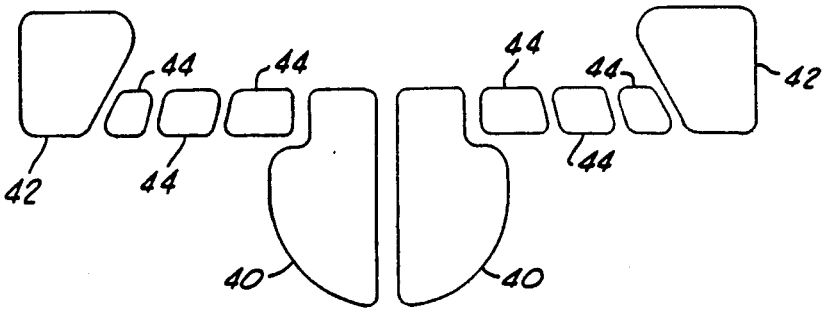
FIG. 6 is a development of the interior surface of the cylinder of FIG. 5 illustrating the port pattern thereof.
Figure 7:
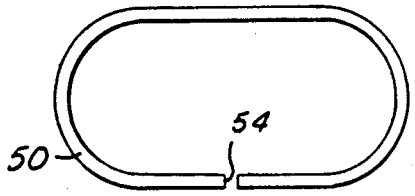
FIG. 7 is a plan view of a piston ring of the present invention.
Figure 9:
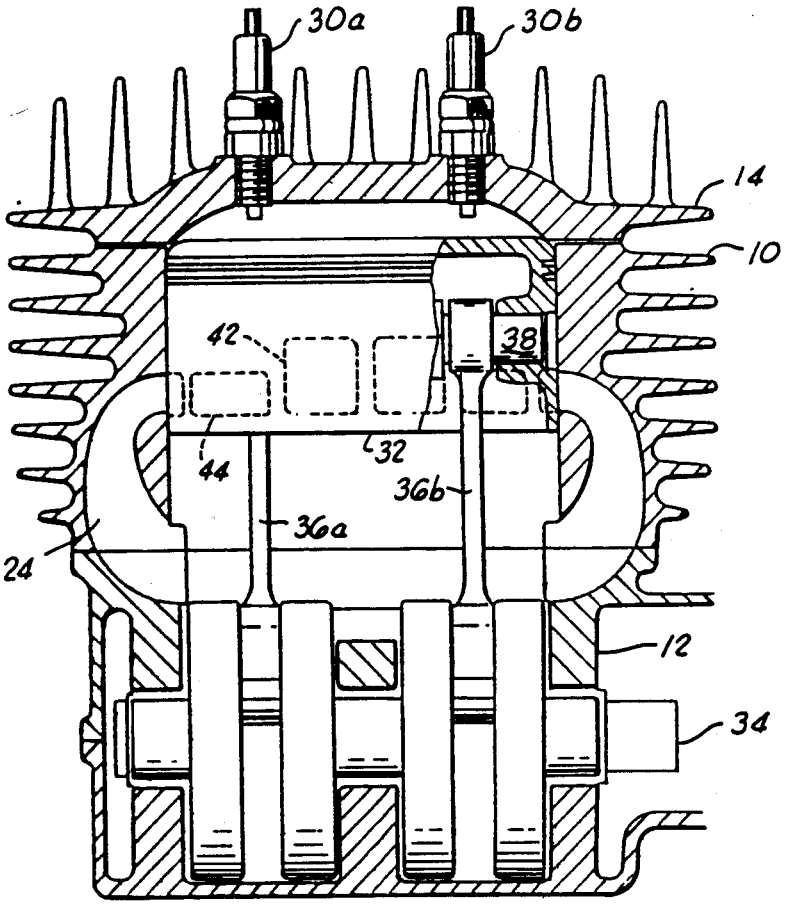
FIG. 9 is a cross-sectional elevation taken along line 9—9 of FIG. 8.
Figure 16:
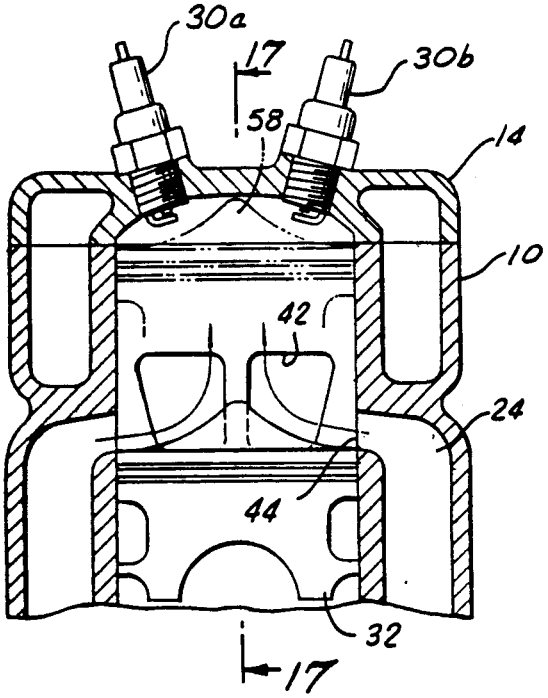
FIG. 16 is a cross-sectional elevation of yet another embodiment of the present invention.
Figure 17:
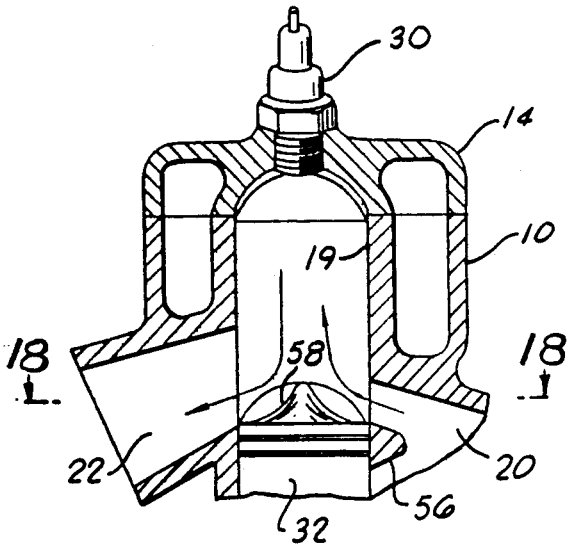
FIG. 17 is a cross-sectional elevation taken along line 17—17 of FIG. 16.
Figure 18:
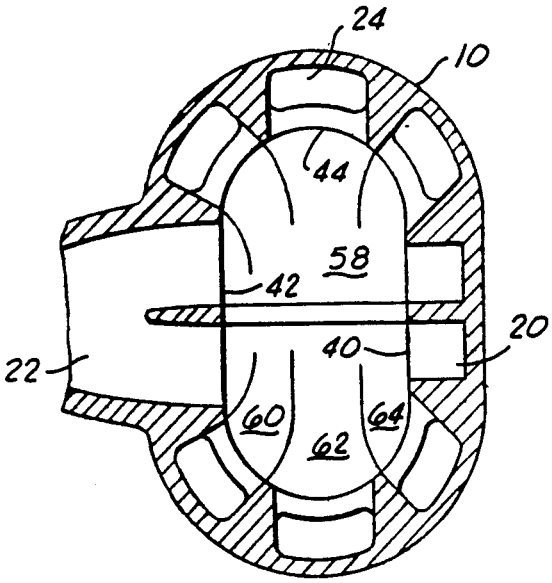
FIG. 18 is a cross-sectional plan view taken along line 18—18 of FIG. 17.
Figure 19:
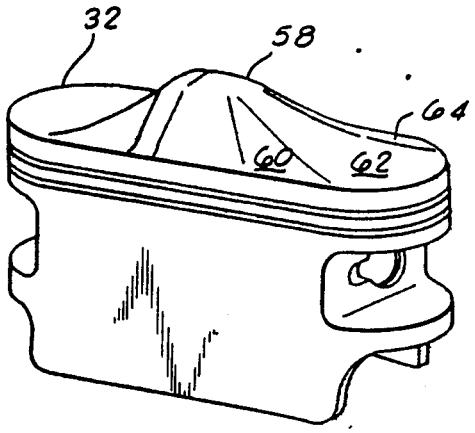
FIG. 19 is an oblique view of a piston of the embodiment of FIG. 16.

Looking then to the embodiment of FIG. 4, corresponding numbers are employed for identical or equivalent elements to those of the first embodiment. The embodiment illustrated in FIGS. 4, 5, 6 and 7 better illustrate the employment of the arrangement of a piston ring 50 set within a groove 52. The piston ring 50 extends substantially about the periphery of the piston 32 in the groove 52. A break 54 is arranged at a midpoint in the long portion of the cylinder wall such that it is generally aligned with a minor cross-sectional axis of the cylinder. The break 54 is further aligned with a solid portion of the cylinder block defining an element 48 of the cylinder 19. The element 48 extends without porting parallel to the direction of movement of the piston 32. In this way, the break 54 in the piston ring 50 does not engage or slide over any porting with the piston 32 reciprocating in the cylinder block 10. As a result, stress and friction are reduced.

Looking then to the embodiment of FIGS. 8–15, again corresponding numbers are employed for identical and equivalent elements to that of the prior embodiments. The piston 32 is shown in this embodiment to include dual connecting rods 36*a* and 36*b* in association with a common wrist pin 38 and crankshaft 34. Dual spark plugs 30*a* and 30*b* reduce the maximum flame path length in the combustion chamber. The ignition plugs 30*a* and 30*b* are spaced along the major cross-sectional axis of the cylinder in the head 14 for best ignition distribution.

Looking specifically to FIGS. 11–14, the scavenging passages 24 are illustrated which include sections approaching the scavenging porting 44 at the cylinder wall 19. The inlet passage 20 acts as an auxiliary scavenging passage arranged in upper and lower inlet openings with a transverse bar 56 forming an upper passage to an upper auxiliary scavenging port 40*a*. In each instance, the portion of the passage 24 or 20 extending to the porting 44 and 40*a* respectively, broadly forms a nozzle to direct the flow of scavenged air/fuel mixture into the combustion chamber. Defined by this portion of each of the passages is an angle of inclination as made with the local normal to the cylinder 19. This angle is represented by "$\theta$" in the figures. The angles of inclination increase from passage to passage in incremental steps away from the exhaust porting 42. Thus, $\theta_1$ of FIG. 14 is less than $\theta_2$ of FIG. 13, etc. $\theta_4$ denotes the largest angle of inclination.

The effect of the foregoing arrangement is to direct air/fuel mixture closest to the exhaust porting 42 laterally across the top of the piston 32, remembering that the scavenging passage 24 closest to the exhaust porting 42 is directed generally toward the intake porting 40. Also it should be noted that the exhaust porting 42 extends upwardly above the scavenging porting 44 and the intake porting 40. From scavenging passages 24 progressively removed from the exhaust porting 42, air/fuel mixture is directed more upwardly to purge the combustion chamber. The upward direction of air/fuel mixture also acts to cool the upper portion of the cylinder and cylinder head surface. The resulting induced flow is to move incoming air/fuel mixture across the top of the piston away from the exhaust porting 42, upwardly adjacent the intake porting 40 where it then may turn back towards the exhaust porting 42. In this way, maximum purging of combusted gases may be achieved in this elongated combustion chamber.

Looking next to the embodiment of FIGS. 16–19, once again numerals corresponding to those denoting identical or equivalent elements in the prior embodiments are employed here. The cylinder block 10 and head 14 illustrate a water-cooled engine rather than the previously described air-cooled engines. Of note in the embodiment of FIGS. 16–19 is the employment of a domed piston 32. The domed surface 58 of the piston 32 is immediately encountered by the incoming air/fuel mixture being scavenged to the combustion chamber. This occurs because the valving of the scavenging porting is accomplished by the top edge of the periphery of the piston 32. The upper surface 58 of the piston 32 is also divided into guide surfaces which are generally concave and particularly arranged to receive the incoming flow from the scavenging passages. The effect of the guide surfaces, 60, 62 and 64 is to particularly direct this incoming flow from specific ports upwardly to purge combusted gases from the combustion chamber and distribute the air/fuel mixture uniformly within the chamber. Arrows in FIGS. 16 and 17 denote this flow. The uniform distribution of air/fuel mixture within the combustion chamber and the presence of two ignition plugs 30*a* and 30*b* help improve the flame path and shorten the flame path length upon combustion. In this way, greater combustion efficiency is achieved in the elongated cylinder.

Thus, a plurality of embodiments of two-stroke internal combustion engines are disclosed, designed to maximize porting area to cylinder volume and minimize such phenomena as short circuiting flow, extended flame path length and high piston ring stress. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A two-stroke internal combustion engine comprising a cylinder, oblong in cross section with a major cross-sectional axis and a minor cross-sectional axis;

intake porting in said cylinder;

exhaust porting in said cylinder, said intake porting and said exhaust porting being centered at said minor axis and opposed in said cylinder;

scavenging porting extending in said cylinder from adjacent said intake porting to adjacent said exhaust porting and including two sets of at least three scavenging ports each, said sets being opposed in said cylinder;

a piston, oblong in cross section and having a peripheral groove; and an oblong piston ring in said peripheral groove, said cylinder being without porting along an element of said cylinder at said minor axis, said element being parallel to the direction of motion of said piston and said piston ring having a brake at the element of said cylinder without porting.

2. A two-stroke internal combustion engine comprising a cylinder, oblong in cross section with a major cross-setional axis and a minor cross-sectional axis;

a piston, oblong in cross section and having a peripheral groove;

porting in said cylinder, said cylinder being without porting along an element of said cylinder at said minor axis, said element being parallel to the direction of motion of said piston; and an oblong piston ring in said peripheral groove, said piston ring having a break at the element of said cylinder without porting.

3. A two-stroke internal combustion engine comprising a cylinder, oblong in cross section with a major cross-sectional axis and a minor cross-sectional axis;

intake porting in said cylinder;

exhaust porting in said cylinder, said intake porting and said exhaust porting being centered at said minor axis and opposed in said cylinder; and scavenging porting extending in said cylinder from adjacent said intake porting to adjacent said exhaust porting and including two sets of at least three scavenging ports each, said sets being opposed in said cylinder;

scavenging passages extending to said scavenging ports, each said scavenging passage terminating at a said scavenging port and defining an angle of inclination with the normal to said cylinder at said scavenging port, each successive scavenging passage progressively increasing in angle of inclination away from said exhaust porting;

a piston, oblong in cross section and having a peripheral groove; and an oblong piston ring in said peripheral groove, said cylinder being without porting along an element of said cylinder at said minor axis, said element being parallel to the direction of motion of said piston and said piston ring having a brake at the element of said cylinder without porting.

4. The two-stroke internal combustion engine of claim 3 further comprising an auxiliary scavenging passage extending to said cylinder and defining an angle of inclination with the normal to said cylinder at said cylinder greater than the angles of inclination of said scavenging passages.

5. The two-stroke internal combustion engine of claim 3 further comprising a piston, oblong in cross section and positioned within said cylinder, said piston including a domed piston head.

6. A two-stroke internal combustion engine comprising a cylinder, oblong in cross section with a major cross-sectional axis and a minor cross-sectional axis;

intake porting in said cylinder;

exhaust porting in said cylinder, said intake porting and said exhaust porting being centered at said minor axis and opposed in said cylinder;

scavenging porting extending in said cylinder from adjacent said intake porting to adjacent said exhaust porting and including two sets of at least three scavenging ports each, said sets being opposed in said cylinder;

a piston oblong in cross section and positioned within said cylinder, said piston including a domed piston head and a peripheral groove; and an oblong piston ring in said peripheral groove, said cylinder being without porting along an element of said cylinder at said minor axis, said element being parallel to the direction of motion of said piston and said piston ring having a break at the element of said cylinder without porting.

7. The two-stroke internal combustion engine of claim 6 wherein said domed piston head has a plurality of guide surfaces thereon, each said guide surface being adjacent a said scavenging port and being generally concave to direct flow from the adjacent said scavenging port upwardly above said piston.

8. The two-stroke internal combustion engine of claim 6 wherein said sets of scavenging ports include at least three scavenging ports each.

* * * * *